US005660805A

United States Patent [19]

Reeves et al.

[11] Patent Number: 5,660,805

[45] Date of Patent: Aug. 26, 1997

[54] METHOD FOR BENEFICIATING TITANIUM-BEARING MATERIAL CONTAINING IRON

[75] Inventors: James William Reeves, Wilmington, Del.; Bo Harry Zander, Storaa; Aake Sandor Ericson, Solna, both of Sweden

[73] Assignee: E. I. Du Pont de Nemours and Company, Wilmington, Del.

[21] Appl. No.: 592,499

[22] Filed: Jan. 26, 1996

Related U.S. Application Data

[63] Continuation of Ser. No. 376,474, Jan. 20, 1995, abandoned, which is a continuation of Ser. No. 232,316, Apr. 25, 1994, abandoned, which is a continuation of Ser. No. 886,310, May 21, 1992, abandoned, which is a continuation-in-part of Ser. No. 650,498, Feb. 5, 1991, abandoned, which is a continuation of Ser. No. 430,892, Oct. 31, 1989, abandoned.

[51] Int. Cl.[6] ..... C01G 23/02; C22B 1/00; C21B 15/00

[52] U.S. Cl. ..... 423/83; 75/474; 75/477; 75/503

[58] Field of Search ..... 75/435, 437, 474, 75/477, 478, 503, 746; 423/75, 76, 77, 83, 85, 86

[56] References Cited

U.S. PATENT DOCUMENTS

| | | | |
|---|---|---|---|
| 2,885,280 | 5/1959 | Greffe | 75/1 T |
| 3,261,664 | 7/1966 | Cairns et al. | 423/77 |
| 3,765,868 | 10/1973 | Moklebust | 75/1 T |
| 3,816,099 | 6/1974 | Stewart et al. | 75/1 T |
| 3,854,929 | 12/1974 | Stewart et al. | 75/435 |
| 3,929,463 | 12/1975 | Svensson | 75/37 |
| 3,977,864 | 8/1976 | Glaeser | 75/1 T |
| 4,295,878 | 10/1981 | Fensom | 75/34 |

FOREIGN PATENT DOCUMENTS

| | | | |
|---|---|---|---|
| 9065654-A | 5/1991 | Australia . | |
| 636408 | 8/1993 | Australia . | |
| 517913 | 10/1955 | Canada | 423/77 |
| 2028487-A | 5/1991 | Canada . | |
| 0000498 | 2/1979 | European Pat. Off. | 423/75 |
| 9005357-A | 5/1991 | Finland . | |
| 9004697-A | 5/1991 | Norway . | |
| 791366 | 2/1958 | United Kingdom | 75/1 T |
| 1397200 | 6/1975 | United Kingdom . | |
| 2000755 | 1/1979 | United Kingdom . | |

OTHER PUBLICATIONS

Gupta, S., et al, "Kinetics of Reduction of Ilmenite with Graphite at 1000 to 1100° C.", Metallurg. Trans. B, vol. 18B, Dec., 1987 pp. 713–8.

Gupta, S., et al, "Reduction of Ilmenite with Carbon", Metallurg. Trans., Jun., 1988, pp. 2–38.

S.N. 07/430,892 Filed Oct. 31, 1989 (CH–1642).

S.N. 07/650,498 Filed Feb. 5, 1991 (CH–1642–A).

S.N. 07886,310 Filed May 21, 1992 (CH–1642–B).

Renison Goldfields Consol.Ltd. (no date).

Light Metals, 1975, vol. 1, p. 365, no month.

"The MINPRO—PAMCO Nickel Segregation Process" by A.S. Ericson, J. Svensson and K. Ishii, publ. International Journal of Mineral Processing 19 (1987) 223–236, no month, (Elsevier Science Publishers B.V., Amsterdam).

*Primary Examiner*—Steven Bos

[57] ABSTRACT

A process for beneficiating particulate titanium-bearing ore containing iron oxides is disclosed. The first step of the process entails prereducing the ore to convert about 20–90 percent of the iron oxides in the ore to metallic iron. Next, the prereduced ore is introduced into a mechanical reduction kiln and contacted with HCl and particulate carbonaceous reducing material. The turning and cascading of the materials in the kiln, in the presence of HCl and the reducing material, converts at least some remaining iron oxide in the ore to metallic iron and causes metallic iron to be liberated from the ore grains. Particulate metallic iron having a particle size of at least 50 microns is thereby formed. Finally, the particulate iron is separated from the ore.

9 Claims, No Drawings

METHOD FOR BENEFICIATING TITANIUM-BEARING MATERIAL CONTAINING IRON

This is a continuation of Ser. No. 08/376,474 filed Jan. 20, 1995, now abandoned, which is a continuation of Ser. No. 08/232,316 filed Apr. 25, 1994, now abandoned, which is a continuation of Ser. No. 07/886,310 filed May 21, 1992, now abandoned, which is a continuation-in-part of Ser. No. 07/650,498 filed Feb. 5, 1991, now abandoned, which is a continuation of Ser. No. 07/430,892 filed Oct. 31, 1989, now abandoned.

BACKGROUND OF THE INVENTION

This invention relates to an improved method for beneficiating titanium-bearing material containing iron.

High grade titanium-bearing material containing low amounts of iron is becoming increasingly scarce and expensive. While low grade titanium-bearing material containing significant amounts of iron can be used in the chloride process for making titanium dioxide pigment or titanium metal, significant amounts of iron chloride byproduct are produced. Some byproduct iron chloride can be used as a flocculant to remove sediment in the treatment process to produce potable water. Because, however, the amount of iron chloride required for this use is limited, the production of significant amounts of iron chloride can be a waste disposal problem.

A number of different processes have been proposed to beneficiate titanium-bearing material containing iron. These processes, however, appear to be deficient in one or more aspects, including, (a) being expensive or not feasible on an industrial scale or (b) producing iron chloride which has the aforementioned disposal problems, and producing low-grade iron.

The following information is to disclose which may be of interest in the examination of this application:

U.S. Pat. No. 3,929,463 discloses a continuous method of effecting an endothermic metallurgical reduction reaction in the reactor space of a rotatable mechanical kiln which functions as a reaction vessel. During the reaction, the charged kiln is rotated at a speed which is lower than the speed at which the charge closest to the kiln ceases to move relative to the wall. The charge is thereby disintegrated and heated to effect the reaction. The reaction carried out can be the reduction of iron, copper, nickel or zinc oxides or sulfides. It is also disclosed that the process can be used to reduce the iron content in titaniferous magnetite and ilmenite in the form of magnetic power which then can be separated magnetically.

British patent 1,397,200 discloses a process for producing metallic iron from materials containing iron oxides and a nonferrous metal oxide. In the process, the oxide containing material is heated in a furnace in the presence of hydrogen chloride, a flux, and a solid carbonaceous material, to a temperature below that at which a slag is formed.

UK published patent application 2,000,755 states that particles containing a mixture of iron and titanium oxide can be heated in a nonoxidizing environment with an iron salt or a precursor thereof to segregate the iron from the titanium bearing component. The process may be applied to beneficiation of ilmenite by first reducing the iron component thereof to metallic iron. The segregated iron can then be separated from the titanium bearing component by physical or chemical means.

An article entitled "Kinetics of Reduction of Ilmenite with Graphite at 1000 to 1100 degrees C." by S. K. Gupta, V. Rajukumar, and P. Grieveson, appears in the December 1987 issue of *Metallurgical Transactions* and discloses an experimental process for reducing ilmenite with graphite. It is stated by the authors that the rate is increased significantly by the addition of ferric chloride, which promotes the nucleation of iron.

An article entitled "Reduction of Ilmenite with Carbon", by D. K. Gupta, V. Rajakumar, and P. Grieveson, appearing in the June, 1988 issue of *Metallurgical Transactions*, discloses an experimental process for the reduction of ilmenite ore with coal in the presence of ferric chloride. According to the authors, the ferric chloride promoted the nucleation of iron and increased the rate of reduction.

SUMMARY OF THE INVENTION

In accordance with this invention there is provided:

Process for beneficiating particulate titanium-bearing material containing iron oxides comprising:

(a) contacting, in a mechanical reduction kiln, particulate titanium-bearing material, particulate carbonaceous reducing material, and HCl or one or more materials which will produce HCl during step (a), or mixtures thereof, said contacting taking place in the substantial absence of titanium chlorination and while (i) the mechanical reduction kiln turns and cascades the material therein, (ii) a temperature of about 900–1100 degrees C. is maintained, and (iii) reducing conditions are maintained, said particulate titanium bearing material having a mean diameter of less than about 40 microns, which diameter exists in the ore which is introduced into the kiln or is ground in the kiln to have such diameter, said step (a) causing iron oxide to be converted to metallic iron and causing liberation of the metallic iron from the titanium bearing material, said contacting continuing until the metallic iron produced in step (b) has a mean diameter of at least about 50 microns, (b) removing the resulting products from step (a) from the kiln, and (c) separating the metallic iron and titanium-bearing material from the resulting products from step (b).

There is also provided a preferred process for beneficiating particulate titanium-bearing material containing iron oxides comprising:

(a) subjecting said particulate titanium-bearing material to reducing conditions in the presence of particulate carbonaceous reducing material to convert about 20–90 percent of the iron oxides to metallic iron, (b) feeding the products resulting from step (a) to a mechanical reduction kiln and contacting the products with one or more particulate carbonaceous reducing materials and solid hydrated ferrous chloride under reducing conditions which cause additional iron oxide to be converted to metallic iron and the solid hydrated ferrous chloride to vaporize, wherein (i) the weight ratio of solid hydrated ferrous chloride to non-reduced iron in the product being fed is about 0.01–0.5, and (ii) the weight ratio of water to ferrous chloride in the solid hydrated ferrous chloride is about 0.03–1.0, said step (b) taking place in the substantial absence of titanium chlorination, (c) removing the products resulting from step (b) from the kiln, (d) contacting the gaseous products from step (c) with water under conditions which form solid hydrated ferrous chloride, and recycling the solid hydrated ferrous chloride to the kiln, and (e) separating the metallic iron and titanium-bearing material from the solid product from step (c).

It has been found that the process of this invention is advantageous because rather than producing iron chloride which can be a disposal problem, it produces high purity metallic iron which can be sold to make various iron products or steel. Also, compared to prior art processes, the process of this invention appears to be able to remove more iron oxides from the titanium-bearing materials.

Other advantages of the process of this invention include:

There is minimal loss of $TiO_2$,

The beneficiation reaction in the mechanical reduction kiln can take place at low temperatures which reduces energy requirements, Very fine particulate metallic iron and $TiO_2$ can be produced by the process, Prereduction reduces the overall time for carrying out the process and appears to enhance the amount of conversion to metallic iron, and The process can be successfully operated with titaniferous materials having a wide range of impurities.

DETAILED DESCRIPTION OF THE INVENTION

Titanium Bearing Material

Any suitable titanium-bearing material containing iron oxides can be used for the process of this invention. Examples include ilmenite, anatase, and titaniferous slags. By iron oxides is meant iron oxides per se, and iron oxides in association, compounds or complexes with other metals, such as $FeTiO_3$.

Prereduction

If this step is used in the process of this invention, particulate titanium-bearing material containing iron oxides is subjected to reducing conditions in the presence of particulate carbonaceous material to convert about 20–90 percent of the iron oxide to metallic iron.

Any suitable reducing conditions can be used. Generally, this will require heating the titanium-bearing material in the presence of a solid carbonaceous material until the desired reduction takes place.

The reduction can take place in a rotary kiln, a fixed kiln, a fluidized bed, or any suitable vessel. Preferably, a rotary kiln should be used.

The heating should be sufficient to carry out the desired reduction and will depend on the type of carbonaceous material and titanium-bearing material being used. Generally, the heating will be in the range of about 900 to 1100 degrees C. and more preferably about 950°–1050° C. Also, generally, sufficient air or oxygen will be excluded to ensure reducing conditions.

Suitable carbonaceous materials include coke, coal, charcoal, lignite, and lignite char. Preferred are lignite, lignite char, and coke. Especially preferred is lignite char. The carbonaceous materials should be in particulate form. Often, one carbonaceous material will have a particle size of greater than about 70 microns to minimize it being blown out of the kiln before it has been reacted.

Preferably, at least a stoichiometric amount of carbonaceous material will be used, although about a 5–30 percent excess can be used if desired to ensure optimum iron metalization.

Generally, the prereduction conditions will be sufficient to convert about 20–90 percent, preferably about 50–70 percent, and most preferably about 60–65 percent of the iron oxide to metallic iron.

For some ores, prereduction is preferred because it can reduce the total time to conduct the process and can enhance the amount of conversion to metallic iron.

Processing in Mechanical Reduction Kiln

This step of the process of this invention comprises (a) contacting in a mechanical reduction kiln, particulate titanium-bearing material, particulate carbonaceous reducing material, and HCl or one or more materials which will produce HCl during step (a), or mixtures thereof, said contacting taking place in the substantial absence of titanium chlorination and while (i) the mechanical reduction kiln turns and cascades the material therein, (ii) a temperature of about 900–1100 degrees C. is maintained, and (iii) reducing conditions are maintained, said particulate titanium bearing material having a mean diameter of less than about 40 microns, which diameter exists in the ore which is introduced into the kiln or is ground in the kiln to have such diameter, said step (a) causing iron oxide to be converted to metallic iron and causing liberation of the metallic iron from the titanium bearing material, said contacting continuing until the metallic iron produced in step (b) has a mean diameter of at least about 50 microns, In one preferred embodiment of this invention, this step comprises feeding prereduced titanium-bearing material to a mechanical reduction kiln and contacting the products with solid hydrated ferrous chloride under reducing conditions which cause additional iron oxide to be converted to metallic iron and the solid hydrated ferrous chloride to vaporize. Subsequently, if desired, the ferrous chloride can be recovered and recycled.

A suitable mechanical reduction kiln, and its method of operation, is described in U.S. Pat. No. 3,929,463 which is hereby incorporated by reference. In principle, the mechanical kiln is a large media mill which is provided with a refractory lining. The mechanical work inside the kiln (e.g. grinding, attrition, friction, etc.) generates a controlled amount of inert heat for the reaction. The use of the mechanical kiln overcomes the problems involved in heat treating large amounts of ore and char or other carbonaceous material with $FeCl_2$, or other source of HCl, without major dilution of the reducing and chlorinating gases.

Thus, in operation, heat is generated by the rotation of the vessel, while the charge is ground to a fine powder, which increases the rate of reaction. The temperature inside the kiln can be controlled by the rotation speed. Also, if desired, additional heat can be supplied from external sources.

Generally, the mechanical reduction kiln should operate at a speed lower than the critical speed. By critical speed is meant that speed above which the charge closest to the kiln wall ceases to move relative to the wall. At speeds lower than the critical speed, the charge will be agitated vigorously by the rotation of the kiln.

Preferably, grinding media will be used in the mechanical reduction kiln. The grinding media should be heavy material and resistant to the atmosphere in the kiln. Often best results will be obtained if the media occupies less than about fifty percent of the volume of the kiln. Preferably, the media will be generally spherically shaped. A preferred griding media is alumina. The media can vary in size depending on the size of the kiln, speed of rotation of the kiln, hardness of the titanium-bearing material, heat required to be generated, etc. Often, the media will have a diameter of about 5–300 millimeters, preferably about 10–200 millimeters, and most preferably about 20–100 millimeters.

The temperature in this step of the invention should be high enough to vaporize the ferrous chloride (if it is used as the source of HCl) but not high enough to cause substantial sintering of the titanium dioxide. Generally, the temperature utilized in this step of the process of this invention will be about 900–1100 degrees C., more preferably about 950–1050 degrees C., and most preferably about 1000 degrees C.

In this step of the process of this invention, there is used HCl, one or more materials which will produce HCl during the processing in the mechanical reduction kiln, or mixtures thereof. Examples of materials which will form HCl include hydrated ferrous chloride, hydrated ferric chloride, chlorinated hydrocarbons, ferric chloride and water, ferrous chloride and water, mixed iron chlorides which are a byproduct from the chloride process to make $TiO_2$ and water, and mixtures thereof. Preferred sources of HCl include HCl, hydrated ferrous chloride, and mixed iron chlorides which are a by-product from the chloride process to produce $TiO_2$.

The amount of HCl used should be sufficient to produce the desired degree of iron metalization and liberation under the conditions in the mechanical reduction kiln. Generally, the amount of HCl required can vary depending upon the temperature, iron content of the titanium containing material, and the rate of grinding in the mechanical reduction kiln. Often the HCl will be present in an amount sufficient to exert a partial pressure in the mechanical reduction mill, of about 0.05 to 0.9 atmospheres, preferably about 0.1–0.6 atmospheres, and preferably about 0.15–0.5 atmospheres.

This step of the process of this invention is conducted under reducing conditions, i.e, under conditions which will cause the iron oxide to be reduced to metallic iron. However, if desired, minor amounts of excess oxygen or air can be admitted to combust or partially combust some of the carbonaceous material. This can be desirable to generate additional heat for the reactions in the mechanical reduction kiln. If this is done, then sufficient oxygen or air will be admitted to provide the desired amount of heat while still maintaining the desired reducing conditions. If excess air or oxgyen is used, it should be noted that use of lignite or lignite char can be especially advantageous because it appears to be very reactive and readily combusts with any oxygen present. The amount of excess air or oxygen admitted can vary greatly depending on the amount of grinding done in the kiln, (and thus the amount of heat generated by the grinding); the desired reaction temperature, the reactivity of the reactants, etc. Often, however, the excess air or oxygen will provide up to about 35 percent, and preferably up to about 20 percent, by volume, of the carbon monoxide exiting the mechanical reduction kiln. If excess air is used, this percentage can be conveniently monitored by analyzing for nitrogen in the gas exiting the mechanical reduction kiln. From the amount of nitrogen, the amount of oxygen can be readily determined from the ratio of nitrogen to oxygen in air.

In addition, this step of the process of this invention is carried out in the substantial absence of titanium chlorination, i.e., generally, less than 5 percent, preferably less than 3 percent, and most preferably less than 1 percent titanium chlorination takes place.

If hydrated ferrous chloride is used as the source of HCl, the weight ratio of solid hydrated ferrous chloride to non-reduced iron in the titanium-bearing material being fed should be about 0.01–0.5, and more preferably about 0.01–0.3.

The weight ratio of water to ferrous chloride in the solid hydrated ferrous chloride should be about 0.03–1.0, more preferably about 0.1–0.6, and most preferably about 0.1–0.2.

Preferably, the particulate titanium-bearing material will have a mean particle size of less than about 50 microns and preferably less than about 40 microns. If the material is reduced to this size prior to being fed to the mechanical reduction kiln, then the amount of grinding required by such kiln can be reduced. However, if desired, material of larger particle size can be fed to the kiln and the action of the kiln can reduce it to smaller particle size. It is important to note, however, that some grinding in the mechanical reduction kiln is important to aid (1) iron oxide being converted to metallic iron, (2) the metallic iron being liberated from the ore, and (3) producing metallic iron having a mean particle size of at least 50 microns.

The carbonaceous materials used in the mechanical reduction kiln can be the same as those specified above for the prereduction step preferred are lignite and lignite char. The carbonaceous material can be fed directly into the mechanical kiln or an excess can be used in the prereduction step, so that when the products of the prereduction step are fed to the mechanical reduction kiln, sufficient carbonaceous material exists for the processing in the mechanical reduction kiln. Preferably, the carbonaceous material will have an average particle size of less than 200 microns, preferably less than 100 microns, and most preferably less than 50 microns. The carbonaceous material can have this particle size when it is introduced into the mechanical reduction kiln or can be ground to this size in the mechanical reduction kiln.

Process optimization can be obtained if the hot products resulting from the prereduction step, if used, are promptly fed to the mechanical reduction kiln, i.e., before the products have cooled to ambient temperature. If this is done, then less mechanical heat will be required to be generated in the mechanical kiln.

Preferably, the iron particles produced in step (b) have a mean particle size of at least about 50 microns. Often the iron particles will have a mean size of about 50–200 microns, and preferably about 50–100 microns. It should be noted that the ability to produce iron of this particle size is an important advantage of this invention since it aids separation from the beneficiated titanium-bearing material resulting from the process, which generally will have a smaller particle size.

The iron produced by the process of this invention can have high purity, e.g., often at least 90–95 percent. Iron of such purity can have high value for producing iron and steel, as well as for powdered metallurgy.

Removing and Separating the Resulting Products from the Mechanical Reduction Kiln These steps of the process of this invention entail:

removing the resulting products from the mechanical reduction kiln, and separating the metallic iron and the titanium-bearing material from the resulting products.

Any suitable means can be used for the separation, including magnetic separation, settling, flotation, classification, washing, hydrocloning, and combinations thereof.

Preferably, magnetic separation is used to separate the metallic iron from the products resulting from step (b). Then flotation can be used to separate the beneficiated titanium dioxide from the remaining reaction products such as char and ash. Another preferred process is hydrocloning.

The following description concerns the removing and separating steps when hydrated ferrous chloride is used in the mechanical reduction kiln and hydrated ferrous chloride is recycled. In such case, the products resulting from the mechanical reduction kiln are removed from the kiln, separated into gaseous and solid products, and further treated.

Specifically, such gaseous products are contacted with water under conditions which form solid hydrated ferrous chloride, and the solid hydrated ferrous chloride is recycled to the kiln. Generally, the temperature used in this step of the invention should be about 140–300 degrees C., and more preferably about 140–240 degrees C. Enough water should be added in this step to form the desired amount of solid, hydrated ferrous chloride. Generally, at least about a stoichiometric amount of water will be used, because if less water is used, some ferrous chloride would be lost. Often, a slight to a moderate amount of excess of water will be used (e.g. 10–30 percent) to aid desired process kinetics and to compensate for some loss of water in the process.

In regard to the solid products, the metallic iron and titanium bearing material are separated therefrom. Any suitable means can be used for the separation, including magnetic separation, settling, flotation, classification, washing, hydrocloning, cycloning, and combinations of the above. Preferably, magnetic separation is used to separate the metallic iron from the products resulting from step (c). Then flotation can be used to separate the beneficiated titanium dioxide from the remaining reaction products such as char and ash. Another preferred process is to use hydrocloning.

Other Process Aspects

The process of this invention can be carried out in a batch or continuous process. Preferred is a continuous process. If a continuous process is used, preferably the steps (a)–(c) (or steps (a)–(e) if hydrated ferrous chloride is used) are carried out simultaneously.

The following example illustrates this invention. Unless otherwise indicated, all percentages and parts are by weight.

EXAMPLE 1

An ilmenite sand with the following chemical analysis was used for this example.

| Material | Percent |
|---|---|
| Fe(total) | 32.8 |
| $Fe_2O_3$ | 19.3 |
| $TiO_2$ | 49.8 |
| MnO | 1.2 |
| $Al_2O_3$ | 1.0 |
| $SiO_2$ | 1.2 |
| CaO | 0.03 |
| MgO | 1.1 |

Before use the ore was roasted for 2 hours at 950° C. to drive off volatiles. The ore was also ground so that approximately 60% had a particle size of less than 45 microns Chemical analysis of the lignite char was as follows:

| Material | Percent |
|---|---|
| C (fixed) | 88–90% |
| S | 0.04% |
| Volatiles | 3.5% |
| Ash | 7% |

Chemical analysis of ash derived from the lignite char was as follows:

| Material | Percent |
|---|---|
| $SiO_2$ | 5 |
| $Al_2O_3$ | 4 |
| CaO | 55 |
| $Na_2O$; $K_2O$ | 2 |
| $Fe_2O_3$ | 8 |
| $SO_3$ | 14 |
| MgO | 12 |

The prereduction of the ore and lignite char was carried out as follows: The ore and lignite char (20% of ore by weight) were ground to a mean particle size of less than 45 microns and mixed for 10 minutes. Then, 100 grams of the mixture was charged into a nickel crucible. To prevent oxidation, the mixture was covered by two layers of cerafiber paper and a covering layer of the same reduction mix. The crucible was also covered by a tight lid. The prereduction was carried out in a 40 cm. by 40 cm. chamber furnace, at 1000° C., for 4 hours. The prereduction converted about 45 percent of the iron oxide in the ore to metallic iron.

The beneficiation of the ore was carried out in a 17 cm. diameter by 50 cm. long mechanical kiln which was electrically heated and operated batchwise.

Prior to introducing the feed materials to the mechanical kiln, they were mixed for 10 minutes. The feed materials consisted of the following: 1000 grams of prereduced ore, 153 grams of lignite char, 52 grams of $FeCl_2 \cdot 4H_2O$, and 103 grams of $FeCl_2$. The prereduced ore had an iron metalization of about 45 percent.

The beneficiation in the mechanical kiln was carried out under the following conditions:

Temperature: 1000° C.

Time, heating up: 2.5–3 hours

Time, beneficiation: 4 hours

Rotation speed: 30 r.p.m.

Grinding media: Not used.

The solid product output from the mechanical kiln was then ground for 30 seconds in a swinging disc mill so that 99 percent had a particle size of less than 45 microns. Afterwards, separation was carried out in a Davis wet magnetic separator under the following conditions:

Beneficiated ore: 20.00 g.

Time: 20 minutes

Magnetizing current: 1.5 amp.

The results from the foregoing process are summarized below in Table 1.

TABLE 1

Results of Beneficiation in a Mechanical Kiln Plus Magnetic Separation

| Beneficiated Ore | | | Magnetics | | | Non-magnetics | | |
|---|---|---|---|---|---|---|---|---|
| Wt % | Fe % | $TiO_2$ % | Wt % | Fe % | $TiO_2$ % | Wt % | Fe % | $TiO_2$ % |
| 93.5 | 37.0 | 50.5 | 34.5 | 94.8 | 2.6 | 54.8 | 2.6 | 83.0 |

In the above Table 1, (a) the weight percent of the beneficiated ore is based on the initial weight of the non-beneficiated ore, (b) the weight percent magnetics is the weight percent of the beneficiated ore which was removed in the magnetic fraction, and (c) the weight percent non-magnetics is the weight percent of the beneficiated ore which was removed as the non-magnetic fraction.

EXAMPLE 2

A refractory lined mechanical reduction kiln having a charge of 65 millimeter diameter $Al_2O_3$ grinding balls was used for this experiment. The mill had an inside diameter of 3500 millimeters and a length of 3800 millimeters. The refractory liner had a thickness of 500 millimeters. Approximately 40 percent of the volume of the kiln was occupied by the grinding balls. The mill had a drive motor power of 240–250 kilowatts.

The kiln was fed with ilmenite preheated to 550–600 degrees C., 100 kilograms of cold lignite char, and 25 kilograms cold HCl gas per hour. The mill temperature equilibrated at 920–940 degrees C. The mill was rotated at 13.2 revolutions per minute. The ore fed analyzed 63.6 weight percent $TiO_2$, 20.6 weight percent iron, 4.7 weight percent miscellaneous oxides and 2.8 weight percent volatiles. The lignite char analyzed 86 weight percent fixed carbon, 7 weight percent volatiles as 7 weight percent ash.

The kiln discharge solids contained 75% of the iron as metal segregated to particles of 60 microns mean diameter. These were separated from the remaining ore by gravity (by use of a hydroclone) and by further magnetic separation-attrition grinding steps. A total of 99% of the metallic iron was recovered. The remainder (i.e., the 25 percent not recovered) was present in the ore as FeO or formed ferrous chloride. The discharge was:

Total discharge=436 Kg/hr

Iron product=63 Kg/hr as 98% Fe, 1% $TiO_2$, 1% C.

$TiO_2$ rich product=295 Kg/hr as 87% $TiO_2$ and 6.6% FeO

Char=58 Kg/hr

FeCl2=20 Kg/hr

The $TiO_2$ recovery was greater than 95% and was in the form of particles averaging 10 microns diameter. The char was the same size.

The offgas from the kiln analyzed as follows:

$H_2$—10 Volume percent $O_2$—0.5 Volume percent $N_2$—7.8 Volume percent

CO—70.9 Volume percent

HCl—6.0 Volume percent $CO_2$—4.8 Volume percent

The invention claimed is:

1. Process for beneficiating particulate titanium-bearing material containing iron oxides comprising:

(a) subjecting said particulate titanium-bearing material to reducing conditions at a temperature of about 900–1100 degrees C., in the presence of particulate carbonaceous reducing material to convert about 20–90 percent of the iron oxides to metallic iron, (b) feeding the products resulting from step (a) to a mechanical reduction kiln and contacting said products with particulate carbonaceous reducing material, and HCl or one or more materials which will produce HCl during step (b) or mixtures thereof, said contacting taking place in the substantial absence of titanium chlorination and while (i) the mechanical reduction kiln turns and cascades the material therein, (ii) a temperature of about 900–1100 degrees C. is maintained, and (iii) reducing conditions are maintained, said particulate titanium-bearing material having a mean diameter of less than about 40 microns, which diameter exists in the ore which is introduced into the kiln or is ground in the kiln to have such diameter, said step (b) causing iron oxide to be converted to metallic iron and causing liberation of the metallic iron from the titanium bearing material, said contacting continuing until the metallic iron produced in step (b) by said conversion and liberation has a mean diameter of at least about 50 microns, (c) removing the resulting products from step (b) from the kiln, and (d) separating the particulate metallic iron and titanium-bearing material from the resulting products from step (c).

2. The process of claim 1 wherein HCl is introduced to the kiln in step (b).

3. The process of claim 1 wherein one or more materials are introduced to the kiln that will produce HCl during step (b).

4. The process of claim 1 wherein the titanium-bearing material is ilmenite and the carbonaceous reducing material of step (b) is lignite or lignite char.

5. The process of claim 1 wherein the mechanical reduction kiln contains grinding media.

6. The process of claim 1 wherein HCl is present in step (b) in an amount sufficient to exert a partial pressure of 0.05 to 0.9 atmospheres.

7. The process of claim 1 wherein the particulate titanium-bearing material has been prereduced to convert about 20 to 90 percent of the iron to metallic iron; the titanium-bearing material is ilmenite; and the mechanical reduction kiln contains grinding media.

8. The process of claim 7 wherein HCl is added to the kiln of step (b) in an amount sufficient to exert a partial pressure of 0.1 to 0.6 atmospheres.

9. The process of claim 7 wherein one or more materials are introduced to the kiln that will produce sufficient HCl during step (b) to exert a partial pressure of 0.1 to 0.6 atmospheres.

* * * * *